United States Patent [19]

Katschinski

[11] Patent Number: 4,480,679

[45] Date of Patent: Nov. 6, 1984

[54] CHILL MOLD FOR MULTIPLE CONTINUOUS CASTING OF WIRES AND CASTING STRANDS WITH SMALL CROSS-SECTIONS FROM METAL

[75] Inventor: Ulrich Katschinski, Essen, Fed. Rep. of Germany

[73] Assignee: Fried. Krupp GmbH, Essen, Fed. Rep. of Germany

[21] Appl. No.: 299,028

[22] PCT Filed: May 21, 1981

[86] PCT No.: PCT/DE81/00074

§ 371 Date: Aug. 28, 1981

§ 102(e) Date: Aug. 28, 1981

[87] PCT Pub. No.: WO82/03998

PCT Pub. Date: Nov. 25, 1982

[30] Foreign Application Priority Data

Dec. 1, 1979 [DE] Fed. Rep. of Germany ..... 2948490

[51] Int. Cl.[3] ..... B22D 11/00

[52] U.S. Cl. ..... 164/420; 164/423; 164/443

[58] Field of Search ..... 164/420, 423, 462, 443, 164/488

[56] References Cited

U.S. PATENT DOCUMENTS 3,459,255 8/1969 Kolle ..... 164/443
3,717,197 2/1973 Strack ..... 164/420
4,037,747 2/1978 Takahashi et al. ..... 164/443

FOREIGN PATENT DOCUMENTS 878383 8/1971 Canada ..... 164/443
2537862 3/1976 Fed. Rep. of Germany ..... 164/420
509839 8/1971 Switzerland ..... 164/443

*Primary Examiner*—Kuang Y. Lin
*Attorney, Agent, or Firm*—Karl F. Ross; Herbert Dubno

[57] ABSTRACT

Chill molds for multiple continuous casting of wires and casting strands with small cross-sections from metal, in particular from copper and copper alloys, are provided with a row of mold hollow spaces with walls from graphite and the walls are cooled with a coolant circle. In order to have to replace upon wear out or operational disturbances only the parts involved and the exchange of the parts nevertheless to remain simple and the space requirements of the chill mold remain low, the chill mold is provided with building elements independent from each other, that is with cooling elements (1) and mold support elements (2), which are disposed alternately and touching each other in a row next to each other or on top of each other as desired. The mold support elements (2) containing the mold hollow spaces (10) are freely movable with respect to their neighboring cooling elements (1). Each mold support element (2) can be individually pressed against a stop face (18') opposite to the casting direction. The cooling elements (1) and the mold support elements (2) can be clamped together cross to the casting direction.

8 Claims, 4 Drawing Figures

CHILL MOLD FOR MULTIPLE CONTINUOUS CASTING OF WIRES AND CASTING STRANDS WITH SMALL CROSS-SECTIONS FROM METAL

FIELD OF THE INVENTION

This is a national phase application corresponding to PCT/DE81/0074 filed May 21, 1981.

The invention relates to a chill mold for multiple continuous casting of wires and strands of small cross-section from metal, in particular copper and copper alloys, where the mold cavities are disposed in a row and have walls of graphite cooled by a coolant cycle.

BACKGROUND OF THE INVENTION

Based on the small casting output of wire chill molds and chill molds for casting strands of small cross-section such horizontal strand casting plants operate according to the multiple continuous casting principle, that is at the same time, for example, four to ten wires or casting strands are produced.

The chill molds known to date for multiple continuous casting comprise either a water-cooled block of graphite having bores acting as mold cavities or graphite tubes disposed in a row, having a cooling jacket from copper tubing with their own water cooling. Considerable disadvantages are associated with each of these two known constructions of chill molds for multiple continuous casting. In the construction first mentioned for example the graphite block containing all bores must be replaced even when only one of the bores does not work properly. The disadvantage of the second construction comprises essentially that its spatial requirements are comparatively large because of the cooling devices coordinated to the individual chill molds. In addition, it is time consuming and not simple to mount and to dismount the graphite tubes when they are, in each case surrounded by a cooling jacket.

OBJECTS OF THE INVENTION

It is an object of the invention to provide a chill mold for multiple continuous of wires and casting strands of small cross-section, which is simple, of low cost and adaptable to different operating conditions. Another object is to provide a chill mold such that the individual mold cavities can be replaces without complicated requirements.

SUMMARY OF THE INVENTION

The object is achieved with a chill mold cavities which alternate with cooling elements each of which has its own cooling bore connectable to the coolant cycle. The cavities each have a graphite insert in a mold support elements forming a row such that for each support element at least two cooling elements are disposed on the sides. Each mold support element individually can be pressed opposite to the casting direction against a stop surface (18') and the cooling elements and the mold support elements can be fastened to each other transverse to the casting direction. The idea on which the invention is based is to compose the chill mold from independent building blocks, that is cooling elements and mold support elements, which in each case form units complete within themselves and which are stacked alternatingly in contact in a row next to each other or possibly on top of each other. The mold support elements containing the mold hollow spaces are freely movable relative to the cooling elements adjacent to them and they can be mounted and dismounted independently from the cooling elements without difficulty. This has the advantage that the mold hollow spaces can be changed in length over a wide range without dismounting of the cooling elements, it is only required that the presently employed mold support elements be replaced by others having a greater or lesser length.

Advantageously the cooling elements and the mold support elements are constructed as parallelepipeds. Building blocks of such shape can be easily produced, they can be combined with simple provisions to a packet or stack and they can be dismounted by straight line shifting parallel to or perpendicular to their longitudinal axis.

In order to increase the cooling effect of the cooling elements on the mold support elements the two cited building blocks are formed from a metal having good thermal conductivity with the exception of the graphite insert. Preferably the cooling elements and the form support elements are constructed from copper or copper alloys.

Preferably each cooling element is provided with a U-shaped bore disposed in a plane vertical to the middle plane passing through the middle axes of the mold hollow spaces. The intake and the exit openings of the U-shaped bore preferably are provided on one and the same front face of each cooling element.

The longitudinal bores of the U-shaped bore of each cooling element are preferably disposed such relative to the two neighboring mold support elements that they are equidistant from the middle axis of the corresponding mold hollow space.

For improving the heat transfer between the neighboring cooling elements and mold support elements a heat conducting paste is applied to at least one of the outside faces via which the cooling elements and the mold support elements are in contact with each other. In particular silicone paste can be used as a thermal conducting paste.

In order to keep the construction width of the chill mold for multiple continuous casting as small as possible, the cooling elements are narrower in a direction transverse to the middle axis of the mold hollow spaces as compared with the mold support elements. Advantageously, the width of the cooling elements is selected such that they can accept the required elements and the cooling bores while providing sufficient strength. In a particular preferred embodiment of the invention apparatus the width of the mold support elements is an integral multiple of the width of the cooling elements; in particular the mold support elements is twice as wide as the cooling elements.

In order to simplify the positioning of the cooling elements and of the mold support elements in a row and in particular the mounting and the demounting of the mold support elements, the recited building elements are jointly disposed at a table plate.

The table plate is provided in the region of the outer positioned cooling elements with two stops of which at least one is adjustable in the direction toward the cooling elements. The adjustable stop can form part of a bracket held by a set screw.

The attachment of the mold support elements is provided by way of a press-against unit, which is supported at the table plate movable cross to the middle axis of the respective mold hollow space. A particularly simple press-against unit comprises a set screw contained in a bracket, the bracket itself is provided with several slots into which fastening and guiding elements engage in the shape of attachment bolts or respectively guide pins.

In order to adjust the coolant amount for each cooling element separately, each is provided with a flow control valve.

The chill mold can advantageously be provided with graphite inserts which protrude on the rear side beyond the cooling elements at the wall of a metal container serving to feed the metal. The rear faces of the graphite inserts serve simultaneously for the fixation of the cooling elements and the sealing.

SPECIFIC DESCRIPTION

The chill mold forming the subject of the application comprises as important elements cooling elements 1 formed as parallelepipeds and mold support elements 2 formed as parallelepipeds, which alternatingly form a row on the guide surface 3' of the table plate 3. The sequence of the building elements 1 and 2, which support each other at their outside surfaces 1' and respectively 2', is selected such that each mold support element 2 is flanked by two cooling elements (FIG. 1).

Figure 1:
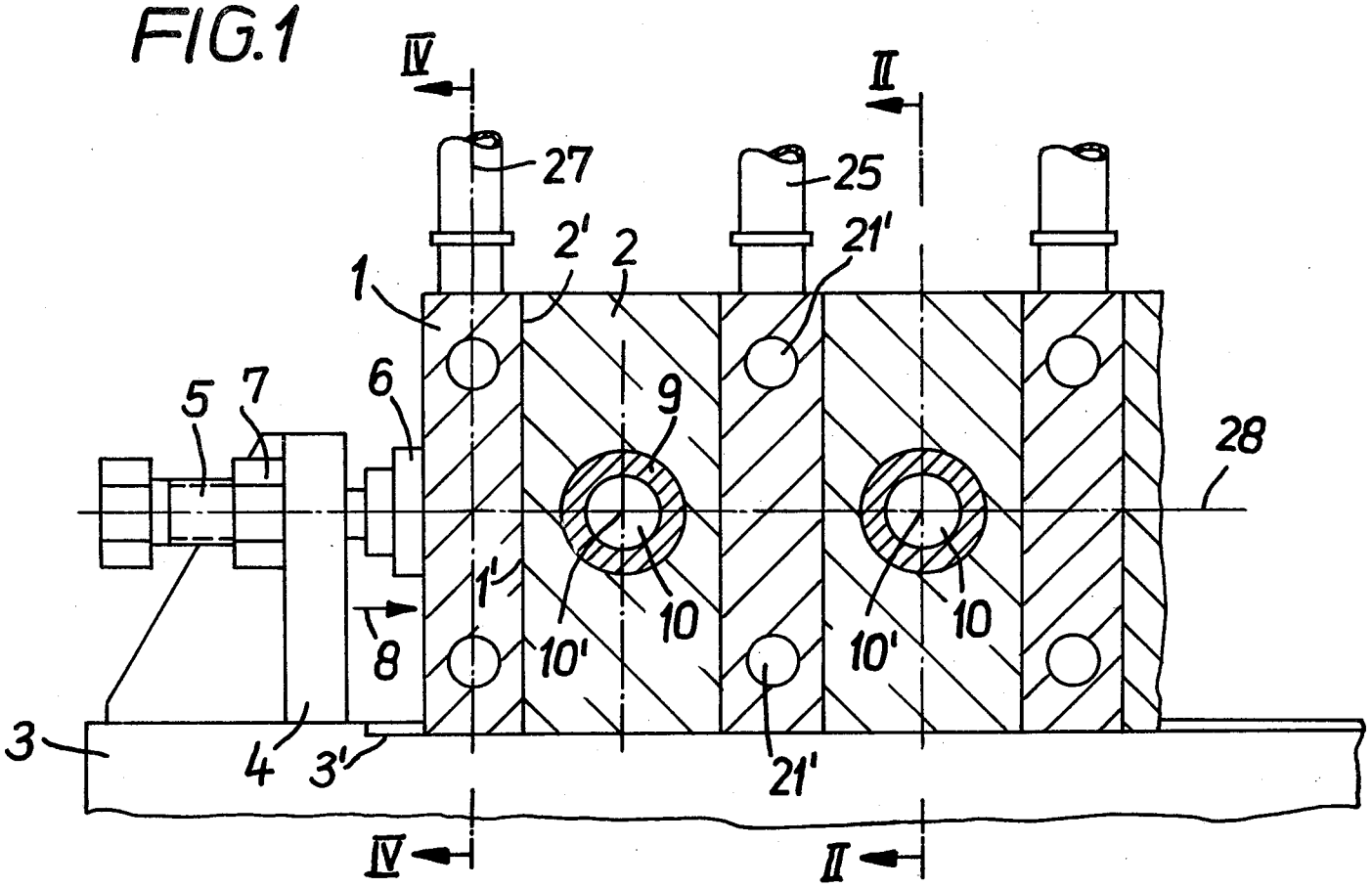
FIG. 1 is a partial section through a chill mold according to the invention taken transversely to the longitudinal axis and the mold support elements (without the second stop with corresponding set screw disposed on the right hand side)

The table plate 3 is provided with at least one bracket 4 with at least one set screw 5 in the region of the two outer cooling elements 1 (of which in FIG. 1 only one is shown). The position of this set screw, which is provided with a stop 6 tiltably disposed on the side toward the cooling element 1, is assured with a safety nut 7.

The counterrunning motion of the stops 6 in the direction of the cooling elements 1, that is by way of moving the stop 6 shown in the direction of the arrow 8, the building elements 1 and 2 are pressed against each other and they are thus integrated or clamped as a unit connected to the table plate 3.

The mold support elements 2 comprise in each case in the middle a tube-shaped graphite insert 9, which surrounds a mold cavity 10 and the cavity 10 has a circular cross-section in the embodiment shown. The middle axis of the mold support element 2 and therewith the middle axis of the mold hollow space 10 is designated as 10' (compare FIG. 2). The graphite insert 9 is provided in the area of its rearward end section with a step 9' by which the insert is supported in the direction of the middle axis 10' at the mold support element.

Figure 2:
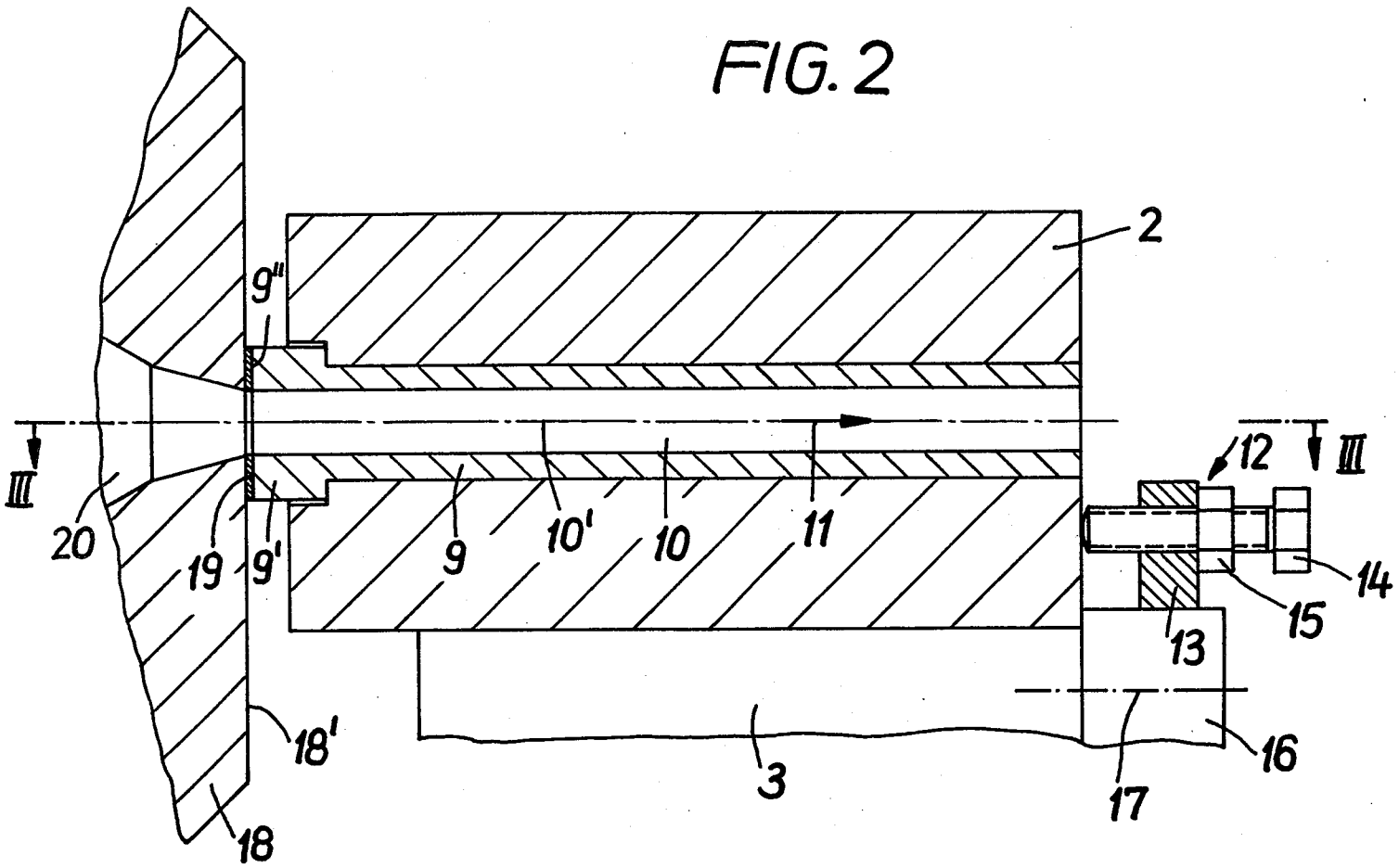
FIG. 2 is a longitudinal section along line II—II in FIG. 1 through a mold support element with preceding metal container and corresponding press-against unit.
Figure 3:
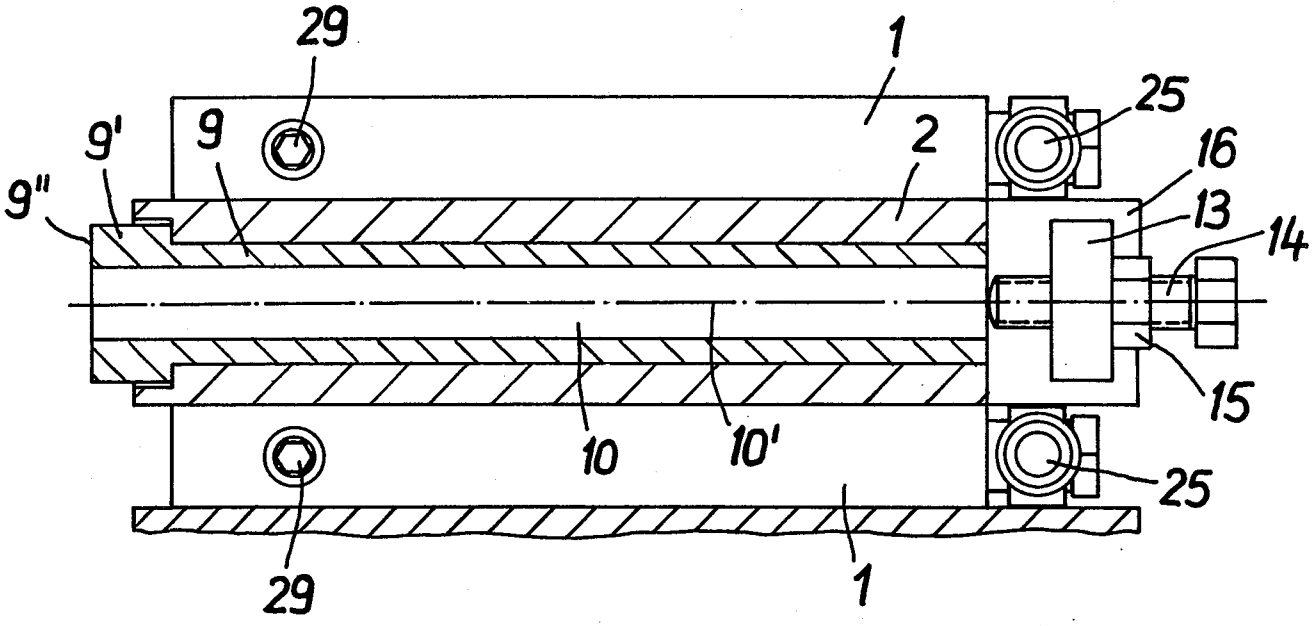
FIG. 3 is a section along line III—III in FIG. 2 (without the prepositioned metal container)

A pressing unit 12 is disposed in front of each mold support element as seen in the casting direction (arrow 11 in FIG. 2). This comprises a bracket 13 with at least one set screw 14 with a corresponding safety nut 15. The bracket is advantageously attached at a foot 16 which is turn is dismountably connected with the table plate 3. In order to have the pressing unit 12 if necessary movable relative to the table plate 3 across to the middle axis 10' of the mold hollow space 10, the foot preferably is provided with slots (not shown), which engage suitable attachment bolts; these are schematically indicated in FIG. 2 by a dot-dash line 17. By the pressing unit 12 the corresponding mold support element 2 can be supported against the casting direction at the wall of a prepositioned metal container 18 and thus its position can be fixed.

The support of the mold support element 2 is thereby provided via the rearward front face 9'' of the graphite insert 9. The mentioned front face is disposed with an intermediate placing of a seal ring 19 in the region of the conical output opening 20 at the wall 18' of the metal container 18 (compare FIG. 2).

The mold element 2 is copper except for the graphite insert 9.

Figure 4:
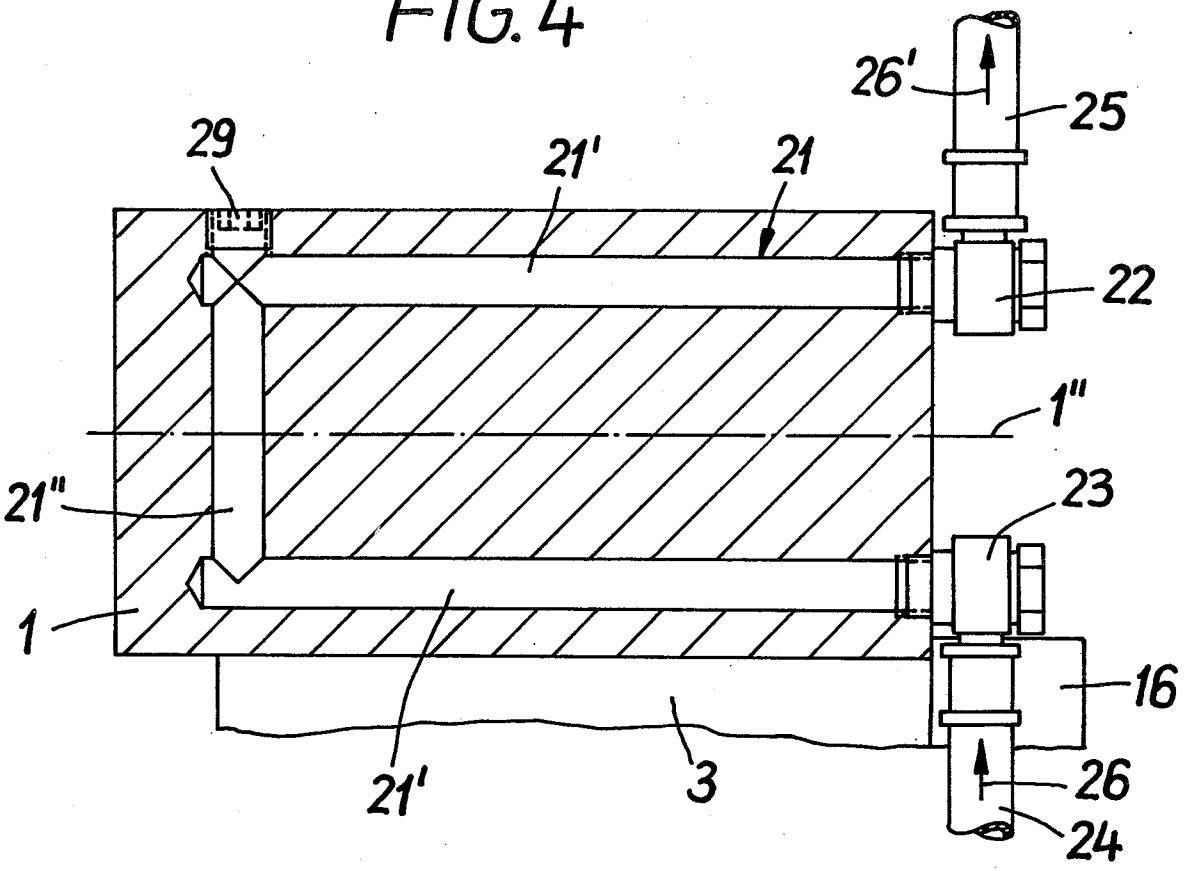
FIG. 4 is a section along line IV—IV in FIG. 1 through a cooling element.

The cooling elements 1 (compare FIG. 4) each comprise a respective coolant bore channel 21, which can be connected via elbows 22,23 and a feed line 24 and a return line 25 to the coolant circulation. The direction of motion of the cooling liquid through the U-shaped cooling bore is shown by two arrows 26 and 26'. The cooling bore comprises two longitudinal bores 21' and one cross bore 21'' and is disposed in a plane 27 (compare FIG. 1) perpendicular to the middle plane 28 containing the middle axes 10' of the mold hollow spaces 10. The longitudinal bores 21' run parallel to the longitudinal axis 1'' or respectively to the middle axis 10' and the cross bore 21'' sealed by way of a closure screw 29 runs perpendicular to it.

The cooling elements 1 are also composed of copper. The longitudinal bores 21' of the cooling element 1 are disposed symmetrically with respect to the corresponding longitudinal axis 1'' and with respect to the middle axes 10', they therefor have the same distance with respect to the axes 1'' and 10'.

In order to improve the cooling of the individual cooling elements 1, in addition between the outside surfaces 1' and 2' (compare FIG. 1) there can be provided silicone paste. The silicone paste equalizes unevenness and machinning-induced deformations and interspaces caused thereby between the outer faces 1' and 2'. A sufficient cooling effect of the cooling elements 2' is also then assured by employing the silicone paste if the outer surfaces 1' and 2' are produced less accurately and with less surface quality.

To conserve material and space, the cooling elements 1 in each case are constructed to be as small as possible provided that they can still receive the cooling bore 21 and possibly the corresponding elbow connections. The latter are disposed in each case at the front face located in front relative to the casting direction of the cooling elements 1. In the embodiment shown in the drawing the cooling elements 1 have a width transverse to the middle axis 10' of the mold hollow spaces 10, which is just half as large as the width of the mold support elements 2.

With a diameter of the mold hollow spaces 10 of 18 mm and with a diameter of the graphite insert of 30 mm the width of the mold support element amounts to 50 mm and the mold support elements are 110 mm high and 210 mm long. The graphite inserts 9 protrude by 10 mm beyond the mold support elements 2. The length of the cooling elements 1 is preferably smaller than that of the mold support elements 2, it amounts to 200 mm in the embodiment shown.

The advantages of the chill mold of the application subject comprise in particular that the chill mold is composed solely from two simple building elements utilizing the principles of a modular system, where in particular the wearing parts, that is the mold support elements, can be taken out upon dismounting of the corresponding clamping unit 12 and can be replaced. The number of the wires or casting strands to be cast at the same time can be influenced as desired by changing the number of elements disposed next to each other or on top of each other.

As long as certain longitudinal extensions are not exceeded, mold support elements of different lengths can be employed without having to exchange the cooling elements. The mold support elements can be connected by way of the corresponding clamping unit individually to the preceding metal container, that is to a casting vessel or also to a heat maintaining oven. If the cooling elements each are provided with a flow control valve then the cooling liquid flowing through can be individually adjusted or controlled by the valves.

The novel chill mold has the further advantage that the modular building elements forming a block comprise simple geometrical bodies and therefore can be produced at low cost.

I claim:

1. A chill mold for the continuous casting of a multiplicity of metal strands comprising:

a plurality of geometrically similar casting bodies of thermally conductive material each formed with a respective continuous-casting cavity for the production of a respective strand;

a plurality of geometrically similar cooling bodies of thermal conductive material each formed with at least one cooling passage;

clamping means for securing said bodies in a stack with each casting body flanked by and pressed between two of said cooling bodies and said cooling bodies alternating with said casting bodies along said stack and said cavities opening at opposite sides of the stack;

means at one of said sides of said stack for feeding molten metal to said cavities whereby said strands emerge from said cavities at the other side of said stack; and means for connecting said cooling passages in a coolant circulation path, said clamping means for securing said bodies in a stack including a table plate forming a support surface, all of said bodies resting against said support surface, said support surface being provided with a pair of stops at opposite ends of said stack and bearing against the cooling bodies at said opposite ends, at least one of said stops being adjustable in a direction toward the other of said stops, and a respective adjustable clamping member bearing against each of said casting bodies and individually urging same towards said one of said sides.

2. The chill mold defined in claim 1 wherein each of said bodies have the configuration of a rectangular parallelepiped.

3. The chill mold defined in claim 2 wherein said thermally conductive material is a metal having high conductivity.

4. The chill mold defined in claim 3 wherein each of said cooling passages comprises a u-shaped cooling channel disposed in a plane perpendicular to a median plane through axes of said cavities.

5. The chill mold defined in claim 4 wherein each of said channels comprises a pair of longitudinal bores equidistant from said plane and parallel to one another.

6. The chill mold defined in claim 3 wherein a thermal conductivity paste is applied to at least one surface of one of said bodies in contact with a surface of another of said bodies.

7. The chill mold defined in claim 3 wherein the widths of said cooling bodies transverse to the axes of said cavities is less than the width of said casting bodies in this direction.

8. The chill mold defined in claim 1 wherein each of said cavities is defined by a graphite insert disposed in the respective casting body and projecting therefrom at said one of said sides, said means at said one of said sides for feeding molten metal to said cavities including a metal container, said graphite inserts bearing against said metal container.

* * * * *